US006247466B1

(12) United States Patent
McPherson

(10) Patent No.: US 6,247,466 B1
(45) Date of Patent: Jun. 19, 2001

(54) DUAL FEED PIVOTING FEED-OUT

(76) Inventor: Mathew A. McPherson, 19055 Incline Rd., Norwalk, WI (US) 54648

( * ) Notice: Subject to any disclaimer, the term of this patent is extended or adjusted under 35 U.S.C. 154(b) by 0 days.

(21) Appl. No.: 09/502,643

(22) Filed: Feb. 11, 2000

(51) Int. Cl.[7] ..... F41B 5/10
(52) U.S. Cl. ..... 124/25.6; 124/900
(58) Field of Search ..... 124/25, 25.6, 900

(56) References Cited

U.S. PATENT DOCUMENTS

| | | | |
|---|---|---|---|
| D. 331,614 | 12/1992 | Martin et al. | D22/107 |
| 3,841,295 | 10/1974 | Hunter . | |
| 3,854,467 | 12/1974 | Hofmeister . | |
| 3,958,551 | 5/1976 | Ketchum . | |
| 3,993,039 | 11/1976 | Groves et al. . | |
| 4,372,285 | 2/1983 | Simonds et al. | 124/90 |
| 4,401,097 | 8/1983 | Simonds et al. . | |
| 4,438,753 | 3/1984 | Simonds . | |
| 4,440,142 | 4/1984 | Simonds . | |
| 4,458,657 | 7/1984 | Stockmar | 124/17 |
| 4,461,267 | 7/1984 | Simonds et al. . | |
| 4,478,203 | 10/1984 | Hayes . | |
| 4,512,326 | 4/1985 | Jarrett . | |
| 4,660,536 | 4/1987 | McPherson . | |
| 4,827,894 | 5/1989 | Schallberger | 124/25 |
| 4,838,236 | 6/1989 | Kudlacek . | |
| 4,909,231 | 3/1990 | Larson . | |
| 4,993,399 | 2/1991 | Chattin | 124/25.6 |
| 5,005,554 | 4/1991 | Shepley et al. | 124/24.1 |
| 5,040,520 | 8/1991 | Nurney | 124/25.6 |
| 5,174,268 | 12/1992 | Martin et al. | 124/25.6 |
| 5,307,787 | 5/1994 | LaBorde et al. | 124/25.6 |
| 5,368,006 | 11/1994 | McPherson | 124/25.6 |
| 5,495,843 | 3/1996 | Larson | 124/25.6 |
| 5,505,185 | 4/1996 | Miller | 124/25.6 |
| 5,515,836 | 5/1996 | Martin et al. | 124/23.1 |
| 5,638,804 | 6/1997 | Remick et al. | 124/25.6 |
| 5,678,529 | 10/1997 | Larson | 124/25.6 |
| 5,782,229 | 7/1998 | Evans et al. | 124/25.6 |
| 5,809,982 | 9/1998 | McPherson | 124/25.6 |
| 5,934,265 | 8/1999 | Darlington | 124/25.6 |

OTHER PUBLICATIONS

Bow & Arrow publication of Apr. 1980.
Bow & Arrow publication Dec. 1975.
Advertising from Allen, The Original Compound Bow, Dec. 1975.
Dynabo (Models M–10 Cheetah & Jim Cox Magnum) Instruction Manual Excerpt, mid–1970's.
Kam–Act "MK–2" Instruction Manual Excerpt, early–1970's.
Kam–Act Instruction Manual Excerpt for Martin Archery, Inc., "New for '74'", mid–1970's.
Ben Pearson Archery advertisement.
Hoyt Archery advertisement.
Browning advertisement.

*Primary Examiner*—John A. Ricci
(74) *Attorney, Agent, or Firm*—Vidas, Arrett & Steinkraus

(57) ABSTRACT

A rotationally mounted cam for use with an archery bow. The cam comprising a primary string feed-out, a secondary string feed-out and a string take-up. The primary string feed-out feeding out a predetermined amount of string when the cam rotates about an axle as the bow is drawn. The secondary sting feed-out arm having an end of the string anchored thereto. The secondary string feed-out independently rotationally mounted to the cam at a rotation point. The cam providing the bow with the capability to provide a predetermined nock point with a smooth and continuous feed which allows the nock point to travel in a straight line through out the draw.

15 Claims, 5 Drawing Sheets

DUAL FEED PIVOTING FEED-OUT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The compound bow is generally characterized by the presence of one or more leveraging devices, typically on the distal ends of the bows limbs. The leveraging devices are used to generate a mechanical advantage favoring the archer. As a compound bow is drawn, the force required to displace the bowstring increases rapidly to a maximum value, typically prior to reaching the mid-point of the draw cycle. At some point beyond mid-draw, the force required to displace the bow string an additional amount decreases with each additional increment of displacement. As a result, at full draw the archer is only required to exert a fraction of the maximum force that was required to initially draw the bow.

One of the earliest compound bows is described in U.S. Pat. No. 3,486,495 to Allen. Although Allen discloses the use of programmed cams, such cams did not actually appear in the marketplace until the advent of computer numerically controlled (CNC) machinery made them economically feasible to produce and sell.

With the advent of CNC machinery, the state of the art has progressed from circular cam profiles to programmed non-circular profiles that result in the ability to store more energy in the bow and therefore provide more energy to accelerate an arrow to a higher launch velocity.

Improvements in cam design have been accompanied by advances in the design of the cable rigging. Some of the early compound bows had auxiliary intermediate idler pulleys with their anchor cables adjustably fastened to the handle sections of the bows. Typically, such bows had two cam elements each mounted independently and requiring very meticulous adjustments to each to synchronize the action of the two cam elements to achieve optimum performance.

More recent dual cam bows have been rigged such that the anchor cables of one cam were secured to the axle which mounts the opposite cam. This tied the system together and provided a degree of corrective feedback that made it difficult to detect discrepancies in eccentric wheel synchronization.

Unfortunately, however, with the advent of programmed cams that were capable of storing even more energy, the cam synchronization problem reappeared and the problem increased with increases in energy storage capability combined with progressively lower holding weights.

The background of compound bow development is well documented in the patents that have been granted in this area and for a deeper understanding of the state of the art one can find additional information in the following patents and the patents which they reference:

| U.S. Pat. No. | Issued To |
|---|---|
| 3,841,295 | Hunter |
| 3,854,467 | Hofmeister |
| 3,958,551 | Ketchum |
| 4,440,142 | Simonds |
| 4,838,236 | Kudlacek |
| 5,040,520 | Nurney |
| 5,307,787 | LaBorde et al. |
| 5,368,006 | McPherson |
| 5,505,185 | Miller |
| 5,678,529 | Larson |

The innovation of the dual feed-out single take-up single cam compound bow, disclosed in U.S. Pat. No. 5,368,006 provided a major step forward in the simplification of the compound bow.

As may be seen from U.S. Pat. No. 5,368,006 as well as many of the cam equipped bows available today, the feed-outs and take-up portions of most cams consist of grooved tracks which function to provide the bow string with a defined guide path. The various cam assemblies are intended to increase bow efficiency and power. However, it is also desirable to provide a cam with increased efficiency but which will also provide a bow with nock point travel which is smooth and continuous, and which provides for a nock point which remains level throughout the drawing of the bow string.

Recently, attempts have been made to modify the dual feed-out single take-up cam in order to provide for improved performance of the bow, notably by adjusting the structure of the cam to provide for even more efficient energy storing capability as well as to improve the movement of the cam for greater efficiency and quieter performance.

The present invention provides for increased energy storing ability and improved efficiency as well as the desired level nock point which is smooth and continuous throughout the draw, while using a simple pulley on the opposing limb of the bow.

Other inventions which may be utilized with, or which may be otherwise relevant to, the present invention are disclosed in the following concurrently filed and commonly assigned applications: U.S. application entitled BOW VIBRATION DAMPER, application Ser. No. 09/503,013, filed Feb. 11. 2000; U.S. Application entitled IMPROVED ELASTICALLY MOUNTED COUNTER WEIGHT, application Ser. No. 09/502,149, filed Feb. 11, 2000; U.S. application entitled ROUND WHEEL CAM, application Ser. No. 09/502,354, filed Feb. 11, 2000; U.S. Application entitled ARCHERY BOW WITH BOW STRING COPLANAR WITH THE LONGITUDINAL AXIS OF THE BOW HANDLE, application Ser. No. 09/502,917, filed Feb. 11, 2000; and U.S. Application entitled LEVEL NOCKING POINT TRAVEL CAM, application Ser. No. 09/502,152, filed Feb. 11, 2000.

For the purpose of this disclosure, all U.S. patents and patent applications and all other publications referenced herein are incorporated herein by reference in their entirety.

BRIEF SUMMARY OF THE INVENTION

The present invention is directed in one embodiment to an archery bow which includes a cam assembly rotatably mounted upon the lower limb of a bow for rotation about an axle. The cam assembly has a primary string groove or track and a secondary string payout arm. A pulley is rotationally mounted to the upper limb of the bow and includes a pulley groove or track. Desirably, the pulley track and the primary string payout track are somewhat coplanar.

The secondary string payout arm is independently rotationally mounted to the cam about a rotation point. During the drawing of bow, the rotation point of the arm travels around the axle and draws the portion of the bow string associated with the arm more toward the inside of the bow thus increasing the tension on the string and providing for a greater amount of stored energy within the bow. The shape and length of the arm also provides for a predetermined amount of bow string to be fed out as the rotation point travels around the axle while momentarily taking up string during the initial moment of cam movement during draw. This unique cam assembly provides the present invention with improved energy storing capability as well as providing a bow with the desired level nock point with a path of travel which is smooth and continuous.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
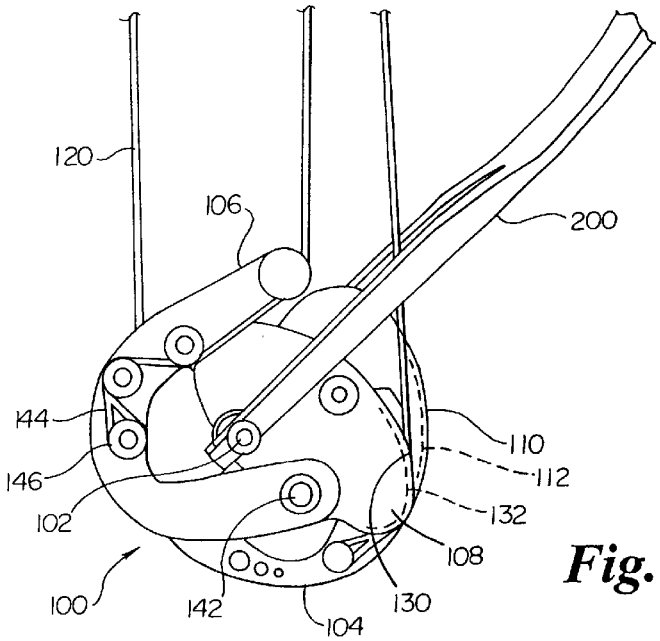
FIG. 1 is a side view of a preferred embodiment of the invention wherein the bow is at rest.
Figure 2:
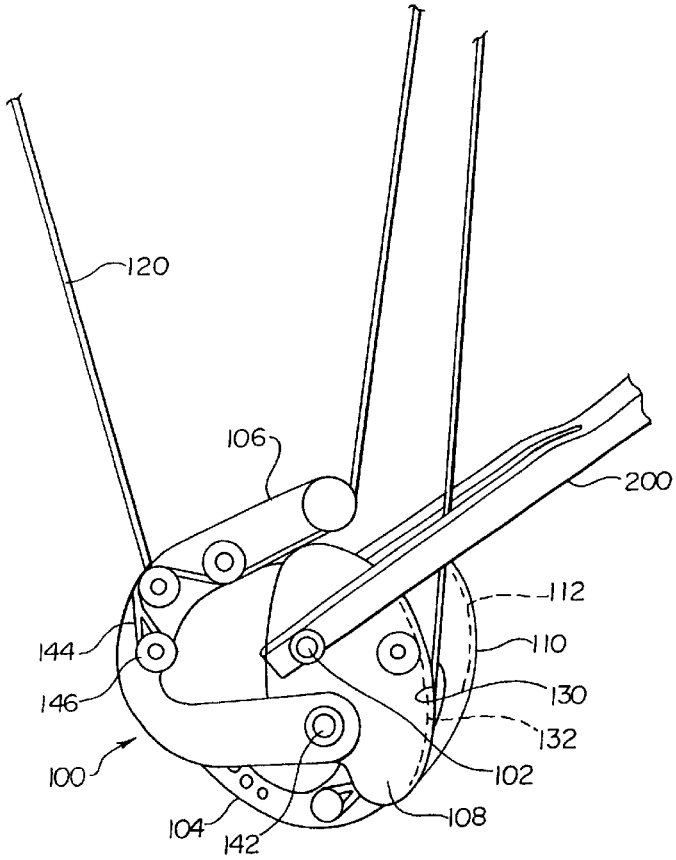
FIG. 2 is a side view of a preferred embodiment shown in FIG. 1 as seen during the initial drawing of the bow.

In FIG. 1 the inventive cam, shown generally at 100 in FIG. 1, is shown as it appears mounted to a bow 200, where the bow 200 is in the undrawn state. The cam 100 is mounted on a first axle pin 102 for rotation thereabout. The cam 100 has a primary string feed-out 104, a secondary string feed-out arm 106 and a string take-up 108.

Preferably, the primary feed-out 104 includes a string guide 110 which is embodied in a first continuous grooved track 112 about the perimeter 114 of the cam 100 and defines a predetermined arcuate path which the string 120 must travel, such as may be seen in the various figures. The shape of the cam and thus the shape of the path determine the quantity of string which is fed out. In an alternative embodiment, the string guide 110 may be defined by an intermittent grooved path or which may be made up of individual components such as one or more posts.

The string take-up 108 includes a second string guide 130 which is also preferably embodied in a continuous grooved track 132. Again the second track 132 defines a predetermined arcuate path which the string travels upon. Similarly to the primary feed-out 104, the shape of the take-up 108 determines the quantity of string taken up. The predetermined arcuate path of the second track 132 preferably has a greater degree of eccentricity than that of the first track 112 of the primary feed-out 104. The predetermined arcuate path of the second track 132 could also be established by providing the take-up 108 with a second string guide 130 which includes an intermittent grooved path or which may be made up of individual components such as previously described.

The present invention improves over the prior art by providing the cam 100 with a secondary string feed-out 106 which is independently rotatably mounted at a predetermined rotation point on the cam.

In the present embodiment, the secondary string feed-out 106 includes a rotation point 142 and a string extension point 143. A string end 144 is anchored to the string extension point 143 by an anchor post 146. The string may be anchored with an anchor post or any attachment means which may be known in the art for securing a string end to a surface.

The rotation point 142 is defined as the point of the secondary string feed-out 106 which is independently and rotationally mounted to the cam. As may be seen in FIG. 1 when the cam 100 is at rest, the rotation point 142 of the secondary feed-out 106 is preferably positioned vertically beneath and forward of the axle pin 102. Preferably, the rotation point 142 is positioned on the cam in quadrant IV such as may be seen in FIG. 7.

As may be understood when the various figures are viewed as a sequence, when the bow is drawn, the rotation point 142 will define a semi-circular arcuate path around the axle pin 102. As may best be seen from a comparison of FIG. 1 and FIG. 5, when the bow is fully drawn the rotation point 142 will have traveled more than 180 degrees around the axle pin 102. Because the rotation point 142 is mounted to a point on the cam 100, the rotation point will always be a constant distance away from the axle pin 102 during rotation of the cam.

As the rotation point 142 is traveling around the axle pin 102 during cam rotation, the string extension point 143 will be moved through a similar semicircular path as that of the rotation point 142 but in a different relative position from the cam as shown. The relative movement of the two portions of the secondary feed-out 106 allows the secondary feed-out itself, to act as an extension of the bow string.

Figure 7:
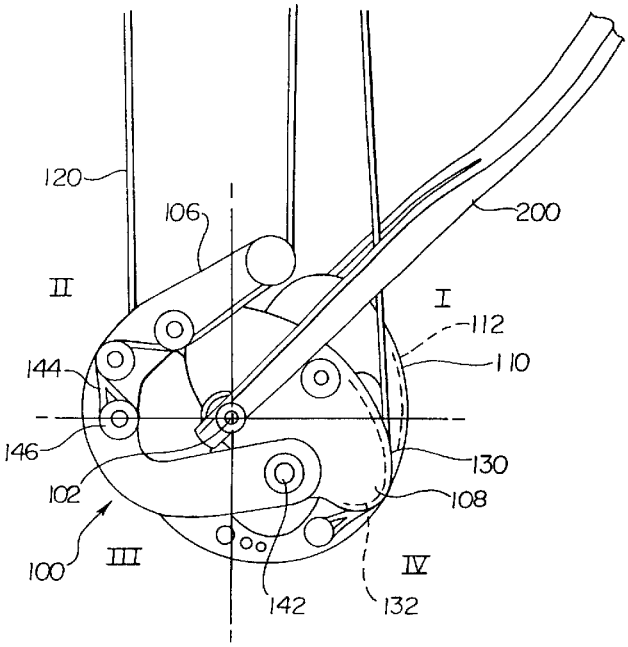
FIG. 7. is a second side view of the embodiment shown in FIG. 1, which includes an illustration of perpendicular axis which defines the invention into four quadrants.

The unique arrangement of providing the cam 100 with an independently rotationally mounted secondary feed-out 106 allows the secondary feed-out 106 to provide a momentary shortening or 'take-up' as the rotation point begins its journey around the semi-circular path. Once the rotation point 142 passes directly vertically beneath the axle pin 102 (i.e. from quadrant IV to quadrant III, as illustrated in FIG. 7) the secondary feed-out will functionally lengthen the string (i.e. 'feed-out'). The degree of initial take-up is dependant upon the initial relative position of the rotation point 142 to the axle pin 102 when the cam 100 is at rest and the effective spring rate of the bow limbs.

In order to better understand the various spatial relationships between the rotation point 142, the string extension point 143 and the axle pin 102, as well as to help understand how the secondary feed-out 106 is capable of momentarily shortening the string and subsequently lengthening the string, an illustration which plots the relative positions of the various elements during cam rotation is provided for in FIG. 6.

Figure 6:
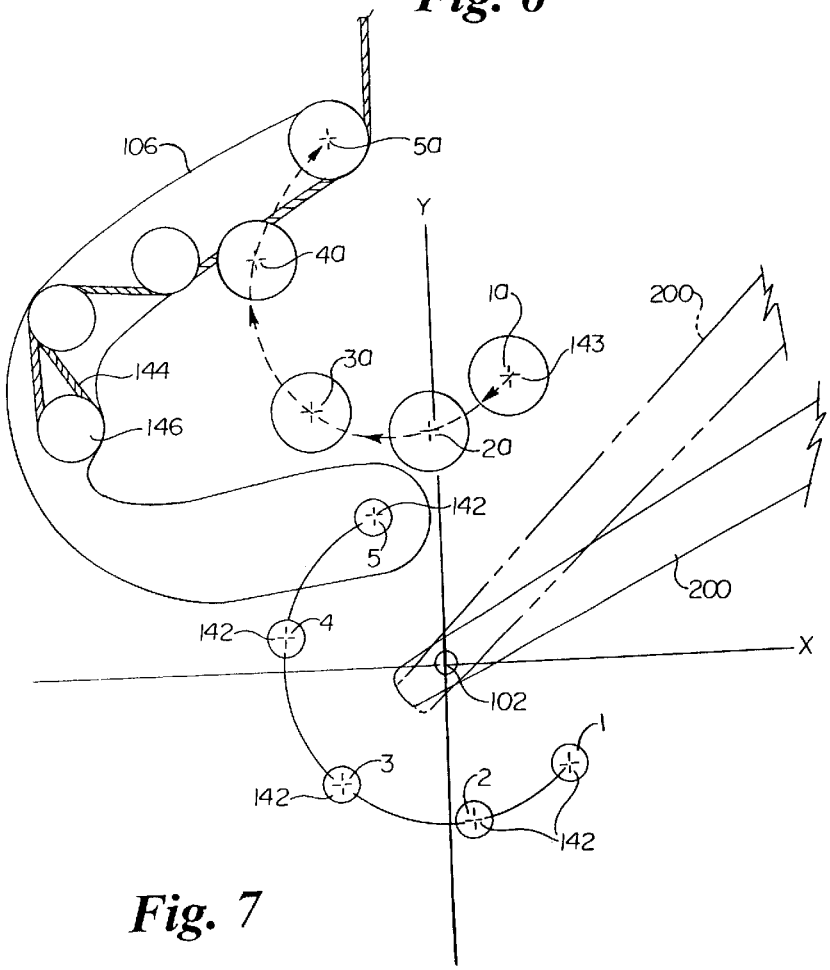
FIG. 6 is a graphical representation of the relative positions of various cam components as they appear over time during cam rotation.

FIG. 6 illustrates the relative spatial positions of the rotation point 142 and the string extension point 143 of the secondary feed-out as the cam rotates through five imaginary moments in time. At point-1 the cam is at rest. During the initial pull of the string, the cam begins rotating. The arcuate line shown between point-1 and point-2 illustrates the initial rotation of the rotation point 142 about the axle pin 102. As the cam rotates, the rotation point 142 will follow the remainder of the semi-circular path indicated by line 147. As the cam rotates the rotation point 142 must initially drop relative to the at rest point-1 and the axle pin 102. When the rotation point 142 drops from point-1*a* to point-2 during the initial rotation of the cam, the string extension point 143 will similarly drop from its at rest point-1*a* to point-2*a*. It is this initial drop in height from point-1*a* to point-2*a* which results in the string extension point 143 to momentarily take-up the string.

Throughout the remainder of the draw action, the rotation point 142 will follow arc line 147 from point-2 to point-5, likewise the string extension will travel from point-2*a* to point-5*a*. From point-2*a* to point-5*a* the string extension point 143 will be extending vertically upward relative to the axle pin 102 to extend or feed-out string.

A primary feature of the present invention is that by providing the secondary feed-out 106 with a momentary take-up effect allows the bow to have a nock point which is completely level as opposed to prior cams which typically allow some fluctuation of the nock point during the draw procedure. As may best be understood from FIG. 6, if the rotation point 142 is located at rest directly vertically beneath the axle pin, no take-up effect would be provided. Therefore, it is a key feature of the present invention to provide the secondary feed-out 106 with a rotation point 142 on the cam, when the cam is at rest, vertically below as well as in front of the axle pin 102. Preferably the rotation point 142 is positioned on the region of the cam referenced as quadrant IV as shown in FIG. 6.

As may be seen in FIG. 6, the path that the free end 143 of the rotationally mounted secondary feed-out takes as the bow is drawn, is normally not identical to the path that its rotation point 142 describes about the cam axle pin 102. The difference in these two paths and the resultant secondary string feed-out is influenced by the spring rate of the bow limbs as well as by the shape of the large string payout profile 104 in combination with the shape of the take-up track profile 108.

Turning back to FIGS. 1–5, as previously indicated, the initial relative drop of the secondary feed-out 106 functions as a momentary take-up of string 120 which would otherwise be available to be drawn and provides for a necessary correction in the available string so as to maintain a level nock point as established by the user.

Figure 3:
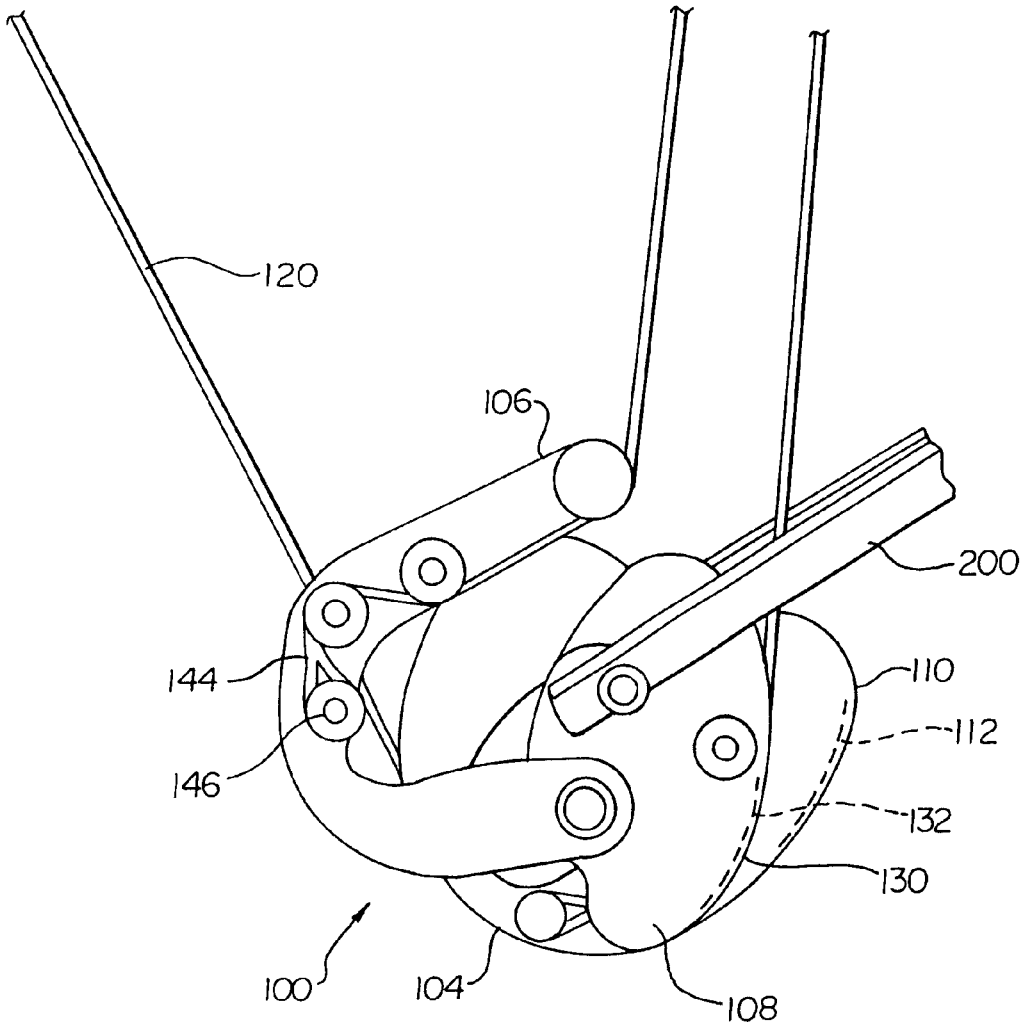
FIG. 3 is a side view of a preferred embodiment shown in FIG. 1 as seen during the drawing of the bow.
Figure 4:
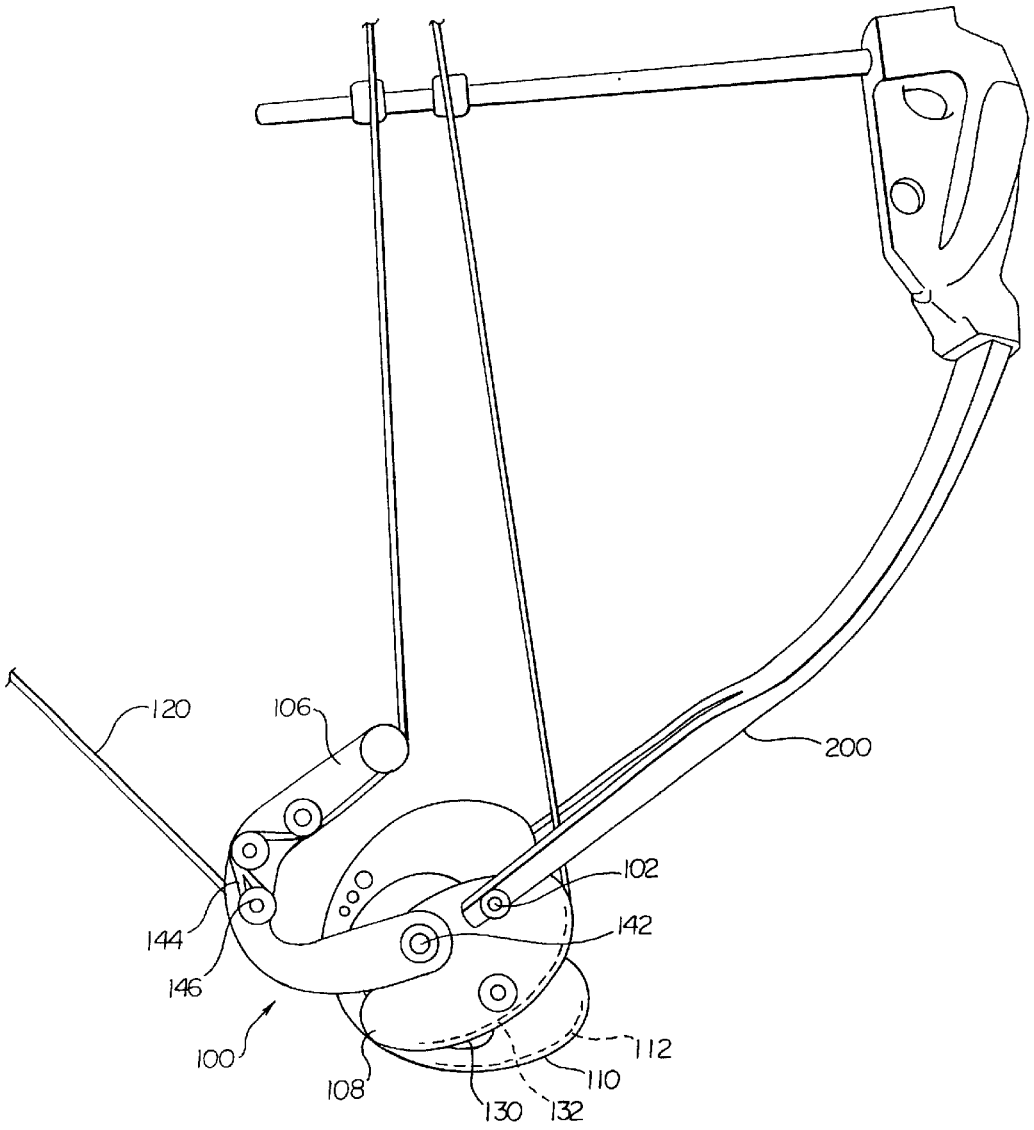
FIG. 4 is a side view of a preferred embodiment shown in FIG. 1 as seen during the drawing of the bow and illustrating the rotational movement of the secondary string payout arm around the axle.
Figure 5:
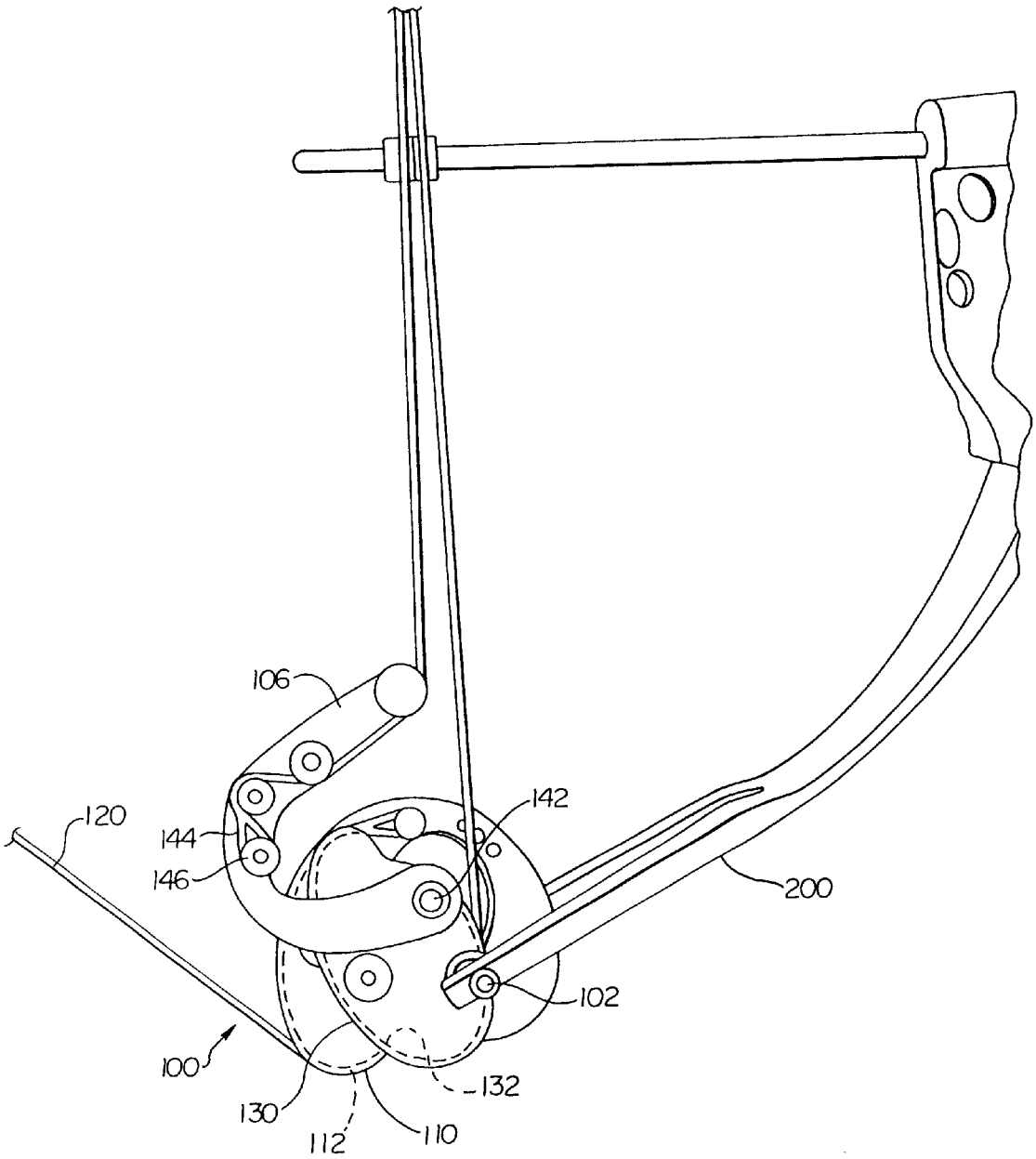
FIG. 5 is a side view of a preferred embodiment shown in FIG. 1 as seen at when the bow is fully drawn.

As may best be seen in FIGS. 3–5, the rotation of the secondary feed-out 106 around the axle pin 102, in effect allows the secondary feed-out 106 to pass through the axle pin 102 and thus provides the bow with a line of force which is closer to the bow at brace and may provide a bow with up to 5% more energy storing potential than a bow equipped with a prior art cam.

What is claimed is:

1. A rotationally mounted cam for use with an archery bow, the cam comprising:

a primary string feed-out, the primary string feed-out constructed and arranged to feed-out a predetermined amount of string when the cam rotates about an axle as the bow is drawn;

a secondary string feed-out, the secondary string feed-out being independently rotationally mounted to a rotation point on the cam; and a string take-up, the string take-up taking up a second predetermined amount of string when the cam rotates about the axle when the bow is drawn.

2. The rotationally mounted cam of claim 1 wherein the secondary string feed-out further comprises an arm.

3. The rotationally mounted cam of claim 2 wherein the arm is substantially U-shaped.

4. The rotationally mounted cam of claim 2 further comprising an axle pin, the axle pin defining an axis of rotation for the cam.

5. The rotationally mounted cam of claim 2 wherein the secondary string feed-out further comprises:

a first end, the first end independently and rotationally mounted to the rotation point on the cam, the rotation point located vertically outward of the axle pin when the bow is in an undrawn condition; and a second end, the second end having an attachment point for securing a secured end of the string thereto.

6. The rotationally mounted cam of claim 5 wherein the rotation point travels around the axle pin in a semi-circular path from an at rest position to a drawn position when the cam rotates, the semi-circular path defining an arc of more than 180 degrees.

7. The rotationally mounted cam of claim 6 wherein the second end of the secondary string feed-out moves from a secondary at rest position toward the axle pin when the rotation point moves from the at rest position to a point directly vertically below the axle pin.

8. The rotationally mounted cam of claim 7 wherein the cam provides for a predetermined nocking point on the string, the predetermined nocking point moves in a straight line relative to the bow during cam rotation as the bow is drawn.

9. The rotationally mounted cam of claim 6 wherein the secondary string feed-out first contracts the string and then extends the string.

10. The rotationally mounted cam of claim 6 wherein the attachment point further comprises at least one anchor post.

11. The rotationally mounted cam of claim 5 wherein the rotation point is positioned on quadrant IV of the cam when the cam is on a lower limb of the bow and the bow is at rest.

12. The rotationally mounted cam of claim 11 wherein the secondary line feed-out is effectively reducing the string length during cam rotation when the rotation point moves from the at rest position in quadrant IV to quadrant III.

13. The rotationally mounted cam of claim 12 wherein the secondary line feed-out extends the string during cam rotation when the rotation point moves through quadrant III to at least one of quadrant II, quadrant I and any combination thereof.

14. The rotationally mounted cam of claim 1 wherein the primary string feed-out, and at least the string take-up each form a respective string track.

15. The rotationally mounted cam of claim 1 wherein the respective string tracks are each comprised of at least one groove.

* * * * *